US009393457B2

(12) United States Patent
Wilkes et al.

(10) Patent No.: US 9,393,457 B2
(45) Date of Patent: Jul. 19, 2016

(54) PORTABLE IMPACT ASSESSMENT DEVICE

(75) Inventors: Floyd Wilkes, Jupiter, FL (US); David Carson, Stuart, FL (US)

(73) Assignee: Hondo Sports Training, LLC, Palm Beach Gardens, FL (US)

( * ) Notice: Subject to any disclaimer, the term of this patent is extended or adjusted under 35 U.S.C. 154(b) by 709 days.

(21) Appl. No.: 13/345,385

(22) Filed: Jan. 6, 2012

(65) Prior Publication Data

US 2012/0197418 A1 Aug. 2, 2012

Related U.S. Application Data

(60) Provisional application No. 61/430,454, filed on Jan. 6, 2011.

(51) Int. Cl.

| | |
|---|---|
| ***G06F 19/00*** | (2011.01) |
| ***A63B 69/32*** | (2006.01) |
| ***A63B 21/16*** | (2006.01) |
| *A63B 63/00* | (2006.01) |
| *A63B 69/00* | (2006.01) |
| *A63B 69/34* | (2006.01) |
| *A63B 71/06* | (2006.01) |

(52) U.S. Cl.

CPC ..... *A63B 21/16* (2013.01); *A63B 69/32* (2013.01); *A63B 63/004* (2013.01); *A63B 69/002* (2013.01); *A63B 69/0097* (2013.01); *A63B 69/345* (2013.01); *A63B 71/0622* (2013.01); *A63B 2210/50* (2013.01); *A63B 2220/17* (2013.01); *A63B 2220/53* (2013.01); *A63B 2220/56* (2013.01); *A63B 2225/50* (2013.01)

(58) Field of Classification Search

CPC .. A63B 2244/102; A63B 21/16; A63B 69/32; A63B 2210/50; A63B 71/0622; A63B 2220/53; A63B 69/345; A63B 69/002; A63B 2220/56; A63B 63/004; A63B 2225/15; A63B 69/0097; A63B 2220/17

USPC ..... 700/91; 482/84

See application file for complete search history.

(56) References Cited

U.S. PATENT DOCUMENTS

| | | | |
|---|---|---|---|
| 2,390,336 | A | 12/1945 | Spearman |
| 2,680,967 | A | 6/1954 | Newman |
| 2,767,920 | A | 10/1956 | Roberson |
| 3,365,947 | A | 1/1968 | Janich, III et al. |

(Continued)

FOREIGN PATENT DOCUMENTS

| | | |
|---|---|---|
| WO | WO8501219 | 3/1985 |

*Primary Examiner* — Omkar Deodhar
*Assistant Examiner* — Wei Lee
(74) *Attorney, Agent, or Firm* — McHale & Slavin, P.A.

(57) ABSTRACT

The present invention generally relates to impact type training equipment for sports. More particularly, the present invention provides a portable impact assessment device that can be utilized across a broad variety of sports equipment to allow an athlete to measure various aspects of impact training. The apparatus generally includes an impact module constructed of a flexible material. The impact module is constructed and arranged to be sufficiently thin and compact to be placed within an impact type training aid within the impact target area of the device. The impact module is fluidly connected to an electronics module so that, upon impacting the training aid, the impact module is compressed to send a fluid signal to the electronics module. A pressure sensor within the electronics module receives the fluid signal generating an electric output that is displayed on a multi digit digital display.

19 Claims, 22 Drawing Sheets

(56) References Cited

U.S. PATENT DOCUMENTS

| | | | | | |
|---|---|---|---|---|---|
| 3,944,225 | A | | 3/1976 | Greany | |
| 4,027,875 | A | | 6/1977 | Hurley | |
| 4,088,315 | A | | 5/1978 | Schemmel | |
| 4,093,217 | A | | 6/1978 | Piccini | |
| 4,108,428 | A | | 8/1978 | Winterbottom | |
| 4,123,053 | A | | 10/1978 | Piccini | |
| 4,185,821 | A | | 1/1980 | Piccini | |
| 4,565,366 | A | | 1/1986 | Struss | |
| 4,823,619 | A | | 4/1989 | D'Antonio et al. | |
| 4,824,107 | A | | 4/1989 | French | |
| 4,850,224 | A | | 7/1989 | Timme | |
| 4,883,271 | A | | 11/1989 | French | |
| 4,941,660 | A | | 7/1990 | Winn et al. | |
| 4,989,865 | A | | 2/1991 | Plevier | |
| 5,269,512 | A | | 12/1993 | Crowson et al. | |
| 5,280,905 | A | | 1/1994 | Micco | |
| 5,281,191 | A | | 1/1994 | DeSousa | |
| 5,503,391 | A | | 4/1996 | Stelly | |
| 5,554,088 | A | | 9/1996 | Zlojutro | |
| 5,738,599 | A | | 4/1998 | Malwitz | |
| 5,741,970 | A | | 4/1998 | Rubin | |
| 5,803,877 | A | * | 9/1998 | Franey | 482/83 |
| 5,853,327 | A | * | 12/1998 | Gilboa | 463/39 |
| 5,980,397 | A | | 11/1999 | Hart et al. | |
| 6,056,674 | A | * | 5/2000 | Cook | 482/83 |
| 6,514,163 | B2 | | 2/2003 | Burns | |
| 6,716,121 | B1 | | 4/2004 | Brown | |
| 6,726,605 | B2 | | 4/2004 | Chen | |
| 6,925,851 | B2 | | 8/2005 | Reinbold et al. | |
| 6,976,926 | B2 | | 12/2005 | LaPointe | |
| 7,128,692 | B2 | | 10/2006 | Black | |
| 7,300,365 | B2 | | 11/2007 | Taylor | |
| 7,479,094 | B1 | | 1/2009 | Alexander | |
| 2003/0069095 | A1 | | 4/2003 | Turos | |
| 2003/0216228 | A1 | * | 11/2003 | Rast | 482/84 |
| 2003/0220177 | A1 | | 11/2003 | Orlando | |
| 2004/0011358 | A1 | * | 1/2004 | Smaldone et al. | 128/200.24 |
| 2004/0048696 | A1 | | 3/2004 | Ciesar et al. | |
| 2004/0097347 | A1 | | 5/2004 | Ghim | |
| 2006/0223657 | A1 | | 10/2006 | Flanigan | |
| 2006/0240917 | A1 | | 10/2006 | Campbell et al. | |
| 2006/0270494 | A1 | | 11/2006 | Presley | |
| 2007/0087911 | A1 | * | 4/2007 | Ghim | A63B 69/20 482/84 |
| 2008/0153590 | A1 | * | 6/2008 | Ombrellaro et al. | 463/30 |
| 2009/0176620 | A1 | * | 7/2009 | Reynolds | 482/8 |
| 2009/0176632 | A1 | | 7/2009 | Wiber | |
| 2009/0291780 | A1 | | 11/2009 | Gutierrez | |

* cited by examiner

PORTABLE IMPACT ASSESSMENT DEVICE

RELATED APPLICATIONS

This application claims priority under 35 USC 119(e) to the U.S. Provisional Patent Application No. 61/430,454, filed Jan. 6, 2011, entitled, "PORTABLE IMPACT ASSESSMENT DEVICE", and is related to U.S. application Ser. No. 12/424,762, filed Apr. 16, 2009, entitled "BASEBALL BATTING STRENGTH TRAINING AID", the contents of which are incorporated herein by reference.

FIELD OF THE INVENTION

The present invention generally relates to impact type training equipment for sports. More particularly, the present invention provides a portable impact assessment device that can be utilized across a broad variety of sports equipment to allow an athlete to measure various aspects of impact training.

DISCUSSION OF THE RELATED ART

Devices for measuring the force of the impact are well known in the art. Such devices include athletic training apparatus that are designed to be struck by an athlete's hands or feet. These athletic training devices are typically adapted to provide the user with an indication of the impact force of his or her punches and kicks, thereby providing the athlete with feedback on his or her performance. Accordingly, the feedback enables the user to improve his or her technique and performance.

An apparatus for measuring impact force is described in U.S. Pat. No. 4,850,224 entitled "IMPACT APPARATUS" issued to Timme on Jul. 25, 1989. The impact measuring device described in the Timme patent employs an impact receiving pad. The impact receiving pad comprises a hollow thin body of high impact polyethylene or equivalent plastic which is lined on its interior surface with polyurethane foam or an equivalent material. The polyurethane foam is adapted to be more resilient than the material used for fabricating the hollow body. The outer surface of the hollow body is lined with a polyethylene foam or like material. The hollow body also defines an air chamber which communicates with a force indicating apparatus via a conduit. Thus, when the pad is struck, air is expelled from the chamber through the conduit to the indicating apparatus which provides an indication of force. The force indicating apparatus disclosed in the Timme patent consist of a rotary disk with a plurality of veins. When the expelled air makes contact with the veins on the disk, the disk rotates and the number of rotations of the disk is counted optoelectrically. The signal created by this arrangement indicates the force of impact.

Another device for providing an athlete with feedback concerning impact force is shown in U.S. Pat. No. 4,941,660 entitled "IMPACT AND SPEED MEASURING SYSTEM" issued to Winn et al. on Jul. 17, 1990. The Winn et al. patent discloses a foam punching bag that includes a bladder for holding water. The cover of the bladder mounts to a pressure transducer. The pressure transducer is coupled to a locally mounted electronic high speed pressure indicator. When the bag is struck by the athlete, an increase in water pressure in the bladder is created and sensed by the pressure transducer. A pressure indicator coupled to the transducer receives a signal from the transducer which is indicative of the increase in water pressure and converts this signal into a reading of force.

Other examples of devices which measure impact force via air pressure generated in some type of punching bag-like apparatus are described in U.S. Pat. No. 2,680,967 entitled "APPARATUS FOR MEASURING MUSCLE STRENGTH" issued to Newman on Jun. 15, 1954, and in U.S. Pat. No. 4,108,428 entitled "PORTABLE PUNCH POWER GAUGE" issued to Winterbottom on Aug. 22, 1978.

Some impact force measuring devices are adapted to be worn on the athlete's hands. For example, in U.S. Pat. No. 2,767,920 entitled "REGISTERING BOXING GLOVE" issued to Roberson on Oct. 23, 1986, describes a boxing glove which includes an integrally formed bladder filled with air. The bladder is coupled to a counter that counts the number of punches that effectively hits a target.

A device which registers the force of blows delivered to a target regardless of the particular location of the blow on the target is disclosed in U.S. Pat. No. 4,565,366 entitled "MARTIAL ARTS PRACTICE DEVICE" issued to Struss on Jan. 21, 1986. This punching device includes a series of electrical switches which operate to register the force of the blows delivered to the device.

U.S. Pat. No. 4,088,315 entitled "DEVICE FOR SELF-DEFENSE TRAINING" issued to Schemmel on May 9, 1978, describes a training dummy having a plurality of separate pressure receptors disposed at various target locations on the dummy for measuring the impact forces of blows made to the various locations.

A device for measuring the time it takes for a person to activate a timer on one switch box and stop the timer by touching a plunger on the other switch box is described in U.S. Pat. No. 4,027,875 entitled "REACTION SPEED TRAINING DEVICE" issued to Hurley on Jun. 7, 1977.

Impact measuring devices which comprise piezoelectric films mounted on deformable materials are disclosed in U.S. Pat. No. 4,824,107 entitled "SPORTS SCORING DEVICE INCLUDING A PIEZOELECTRIC TRANSDUCER" issued to French on Apr. 25, 1989, and U.S. Pat. No. 4,883,271 entitled "SPORTS IMPACT MEASURING DEVICE" issued also to French on Nov. 28, 1989.

U.S. Pat. No. 5,741,970 entitled "IMPACT MEASURING APPARATUS" issued to Rubin on Apr. 21, 1998, discloses a device that includes a foam filled impact receiving portion. The impact receiving section includes an open cell foam layer for generating pulses from impacts and a pulse guiding area filled with fibrous filter material and backed with closed cell foam and a rigid solid member.

Thus, it is apparent from the above list of patents that many different devices have been developed over the years for measuring the force of impacts such as punches and kicks. Of these prior art devices, none of them are capable of being moved from one training apparatus to another. All known impact training devices are built for a single training purpose that cannot be modified. The above mentioned devices all require portions of the force measuring device to be built into the training device in a fixed manner such that removal would disable the training aid as well as the impact measuring device. The specific construction significantly increases the cost to consumers of purchasing training equipment, as each piece of equipment requires its own electronics. The specific construction also requires the user to learn to use the electronics of each impact measuring device which may function and display in a vastly different manner. Further, the non-portability of the prior art devices lack consistency in impact assessment across a wide variety of impact training devices. In effect, each device has its characteristics that prevent a trainee from receiving consistent information regarding their training.

It is therefore desirable to have an impact assessment device that is portable in nature such that it can be transferred from one training device to another to provide consistency and uniformity to training across a wide variety of impact training devices.

It is therefore a primary object of the present invention to provide a portable impact assessment apparatus for measuring the force of an impact delivered thereto.

It is another object of the present invention to provide a portable impact assessment apparatus that can be utilized in a wide variety of impact training apparatus.

It is a further object of the present invention to provide an affordable and robust portable impact assessment apparatus suitable for measuring and displaying the force and/or number of impacts on an impact training apparatus.

It is a further object of the present invention to provide an impact assessment apparatus that can be moved from one impact training apparatus to another.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

SUMMARY OF THE INVENTION

Figure 1:
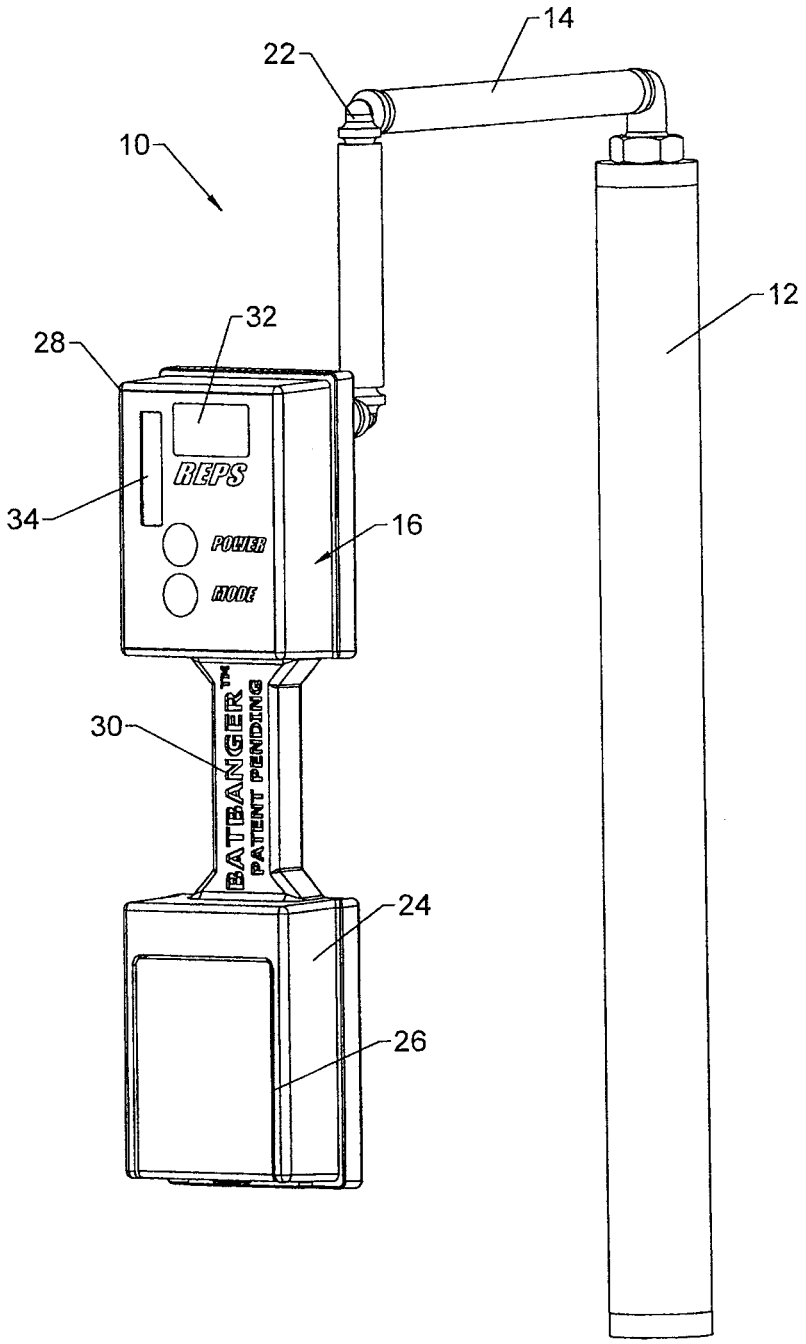
FIG. 1 is a front perspective view of the portable impact assessment device.

The present invention generally relates to impact type training equipment for sports. More particularly, the present invention provides a portable impact assessment device that can be utilized across a broad variety of sports equipment to allow an athlete to measure various aspects of impact training. The apparatus generally includes an impact module, an electronic module and a conduit for fluid connection of the two. In some embodiments an optional manifold is provided to allow connection of multiple electronic modules to a single impact module or several impact modules to a single electronic module. The impact module is constructed of a flexible resilient material. The impact module is constructed and arranged to be sufficiently thin and compact to be placed in a variety of areas within an impact type training aid, and preferably within the impact target area of the training aid. The impact module is fluidly connected to an electronic module so that, upon impacting the training aid, the impact module is compressed to send a fluid signal to the electronic module. A pressure sensor within the electronics module receives the fluid signal, generating an electric output that is conditioned and amplified before entering a microprocessor. The user selects the type of output desired from the microprocessor for display on a multi digit digital display. In addition to the digital display, a portion of the data may be displayed on a simple linear display to display, for example, an indicator of impact strength.

These and other features, aspects, and advantages of the invention will be further understood and appreciated by those skilled in the art by reference to the following written specification, claims and appended drawings.

DETAILED DESCRIPTION OF THE PREFERRED EMBODIMENT

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
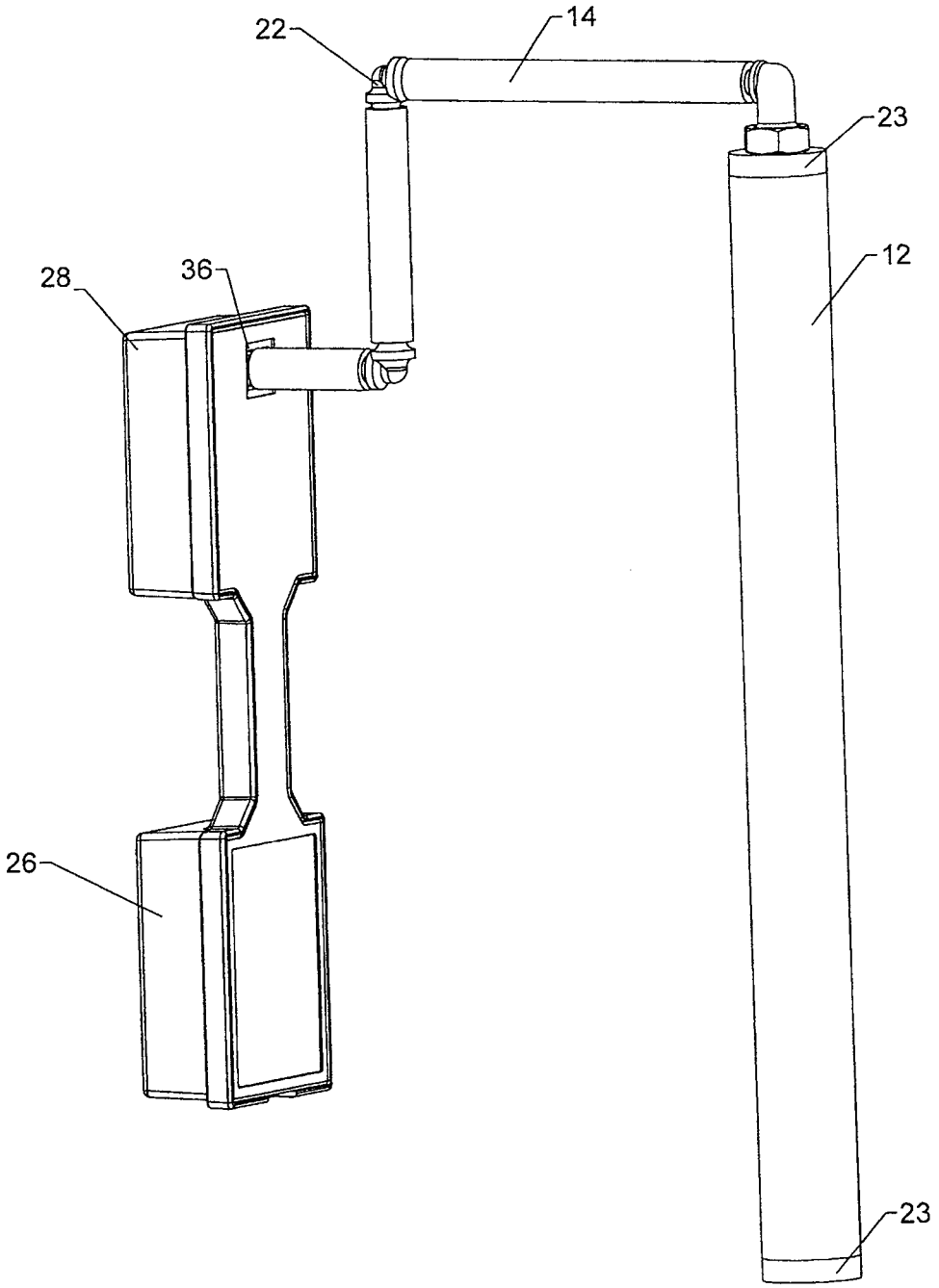
FIG. 2 is a rear perspective view of the portable impact assessment device.
Figure 3:
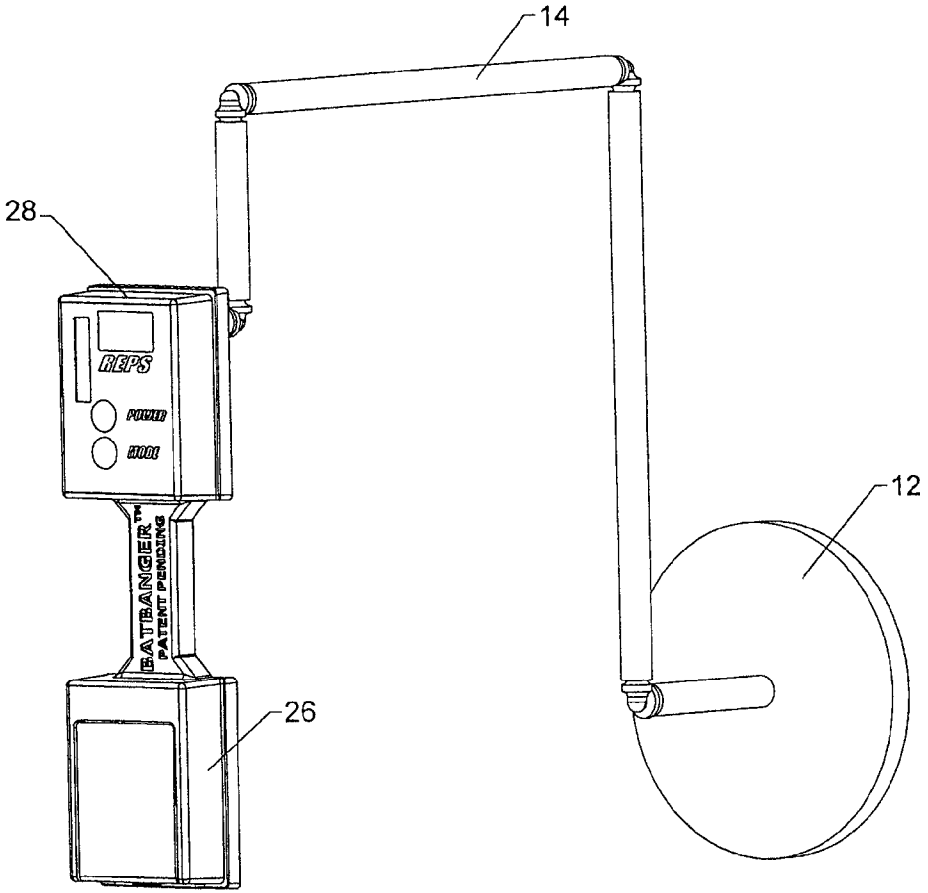
FIG. 3 is a front perspective view of an alternative embodiment of the portable impact assessment device.
Figure 4:
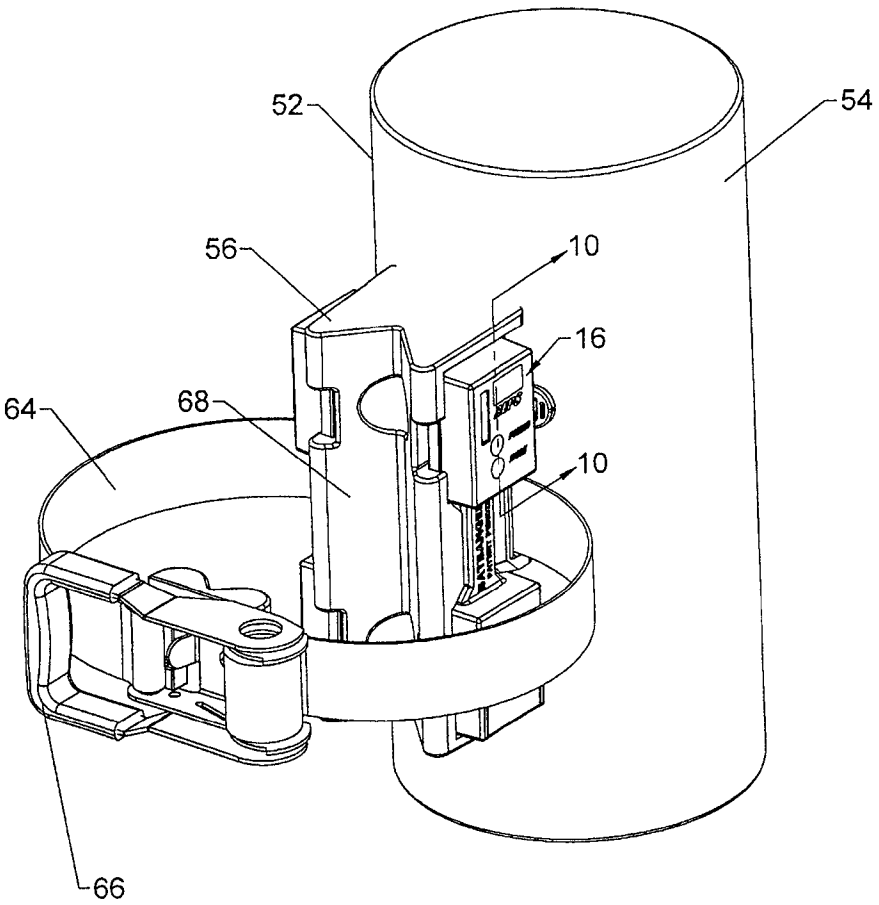
FIG. 4 is a rear perspective view of the portable impact assessment device inserted into an impact training device.
Figure 5:
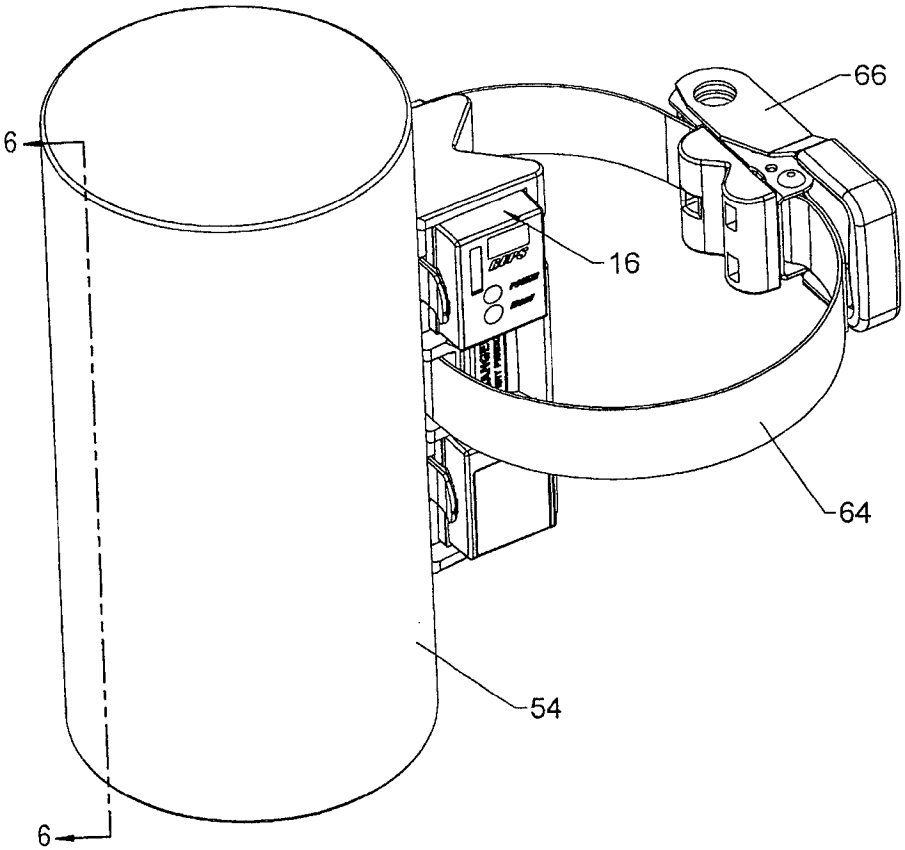
FIG. 5 is a front perspective view of the embodiment illustrated in FIG. 4.

For purposes of description herein, the terms “upper”, “lower”, “left”, “rear”, “right”, “front”, “vertical”, “horizontal”, and derivatives thereof shall relate to the invention as oriented in FIGS. 1 and 2. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-3, and 7-12, a portable impact assessment device 10 is illustrated. The portable impact assessment device generally includes an impact module 12 fluidly connected via a tubular conduit member 14 to an electronics module 16. The impact module is preferably constructed from a resilient material of sufficient size to contain sufficient volume of a fluid, such as air, to create a pressure impulse upon receiving an impact. In a most preferred embodiment, the impact module is cylindrical in shape and sets vertically within the training aid with the conduit member extending from a top surface of the impact module. A pair of ends 23 is secured to the distal ends of the tube in a manner well known in the art. The conduit 14 is generally tubular in shape and is sufficiently rigid to transfer the fluid signal to the electronics module without significant loss of signal strength. In a preferred embodiment, the tubing is polyethylene tubing and may include one or more fittings 22 to allow the fluid signal to be transferred through a tortuous path.

The electronic module 16 includes a case 24 generally divided into a battery portion 26 and a display portion 28 linked by a narrowed portion 30. The display portion preferably includes the circuit boards required for operation of the device, a three digit display 32 and a ten segment LED display 34. In a preferred embodiment, the three digit display 32 is utilized to display a count of the number of hits received by the impact module, while the ten segment display is calibrated to display the force of each impact in a range of 0 to 1000 ft/lbs of force with each segment representing 100 ft/lbs of force. However, it should be noted that the device can be calibrated for metric measurement or a different range of measurement without departing from the scope of the invention. It should also be noted that the three digit display 32 can be utilized to display to a lb/ft measurement or other equivalent measurement to give the user a direct reading of the impact force received by the device. In a preferred embodiment, the fluid signal or pulse is delivered to the rear of the electronic module 16 through port 36 which may be directly coupled to conduit 14 as shown in FIGS. 1-3, 12. Alternatively, the electronics module may be coupled to a manifold 40, illustrated herein as a mount assembly 56, see FIGS. 4, 5, 7-11. The manifold is preferably constructed and arranged to support the impact assessment device on a variety of surfaces and includes at least one internal passage 42 (FIGS. 10-11) in fluid communication with the conduit 14. The outlet of the internal passage 42 is preferably provided with a check valve 44 to prevent loss of the fluid pulse should an electronic module not be connected to each internal passage. The electronic module 16 may be provided with an extension 46 that is constructed and arranged to cooperate with the check valve to open the internal passage when snapped onto the manifold. In this manner, multiple passages and/or electronic modules may be utilized on a single impact aid. This configuration also allows the impact module to be embedded within the impact training aid so that the electronics module can be easily transferred from one training aid to another, or so each athlete can consistently use his/her own electronic module on a plurality of impact training aids. The battery portion 26 of the electronic module 16 is preferably constructed and arranged to contain at least one battery 48 (FIG. 12) in electrical connection with the circuit boards 50 and the displays 32 and 34. In a most preferred non-limiting embodiment, the battery is a single nine volt battery for portability and reduced weight. However, it should be noted that other battery configurations or plug in transformers well known in the art may be utilized without departing from the scope of the invention.

Figure 6:
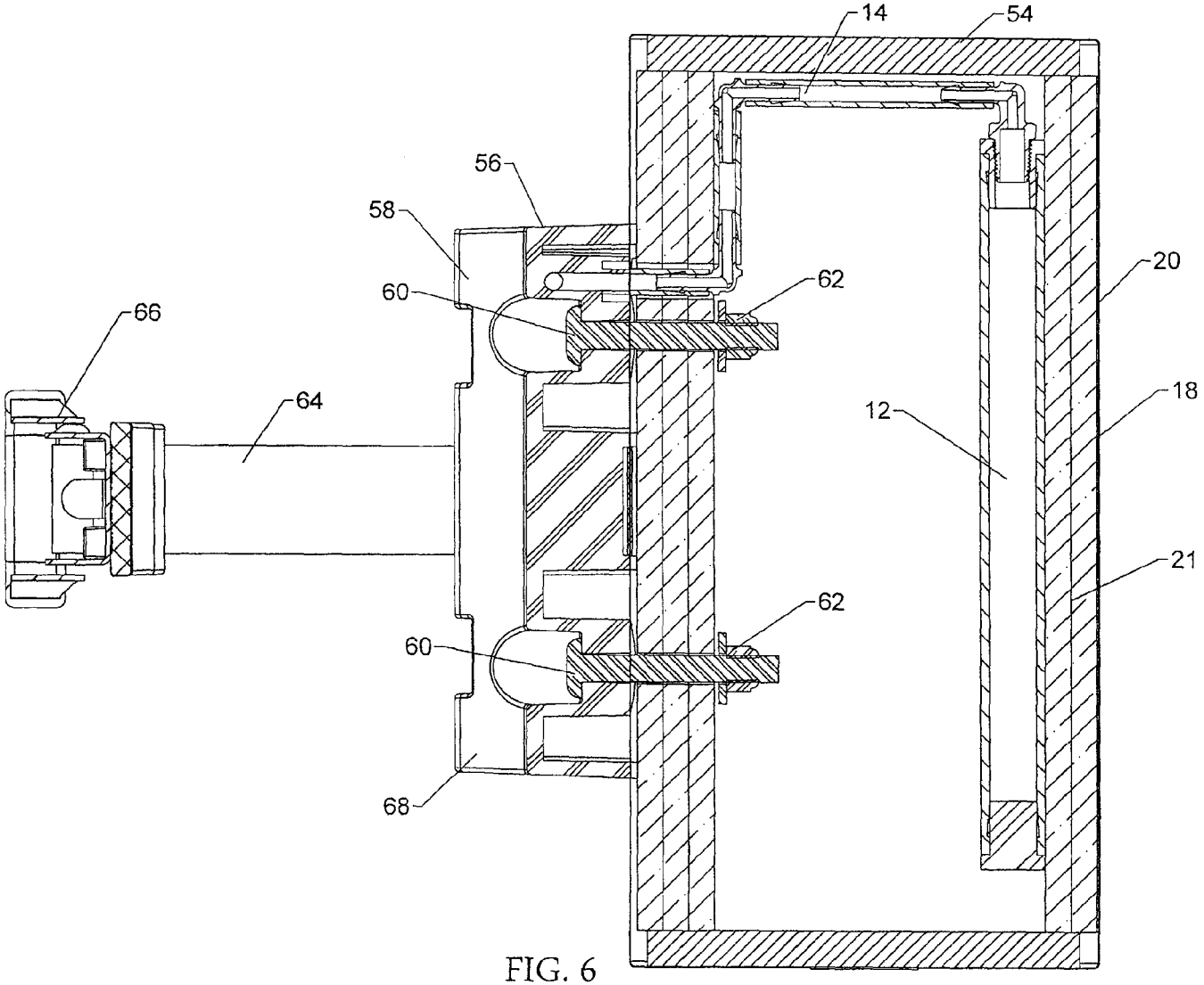
FIG. 6 is a section view taken along lines 6-6 of FIG. 5.
Figure 7:
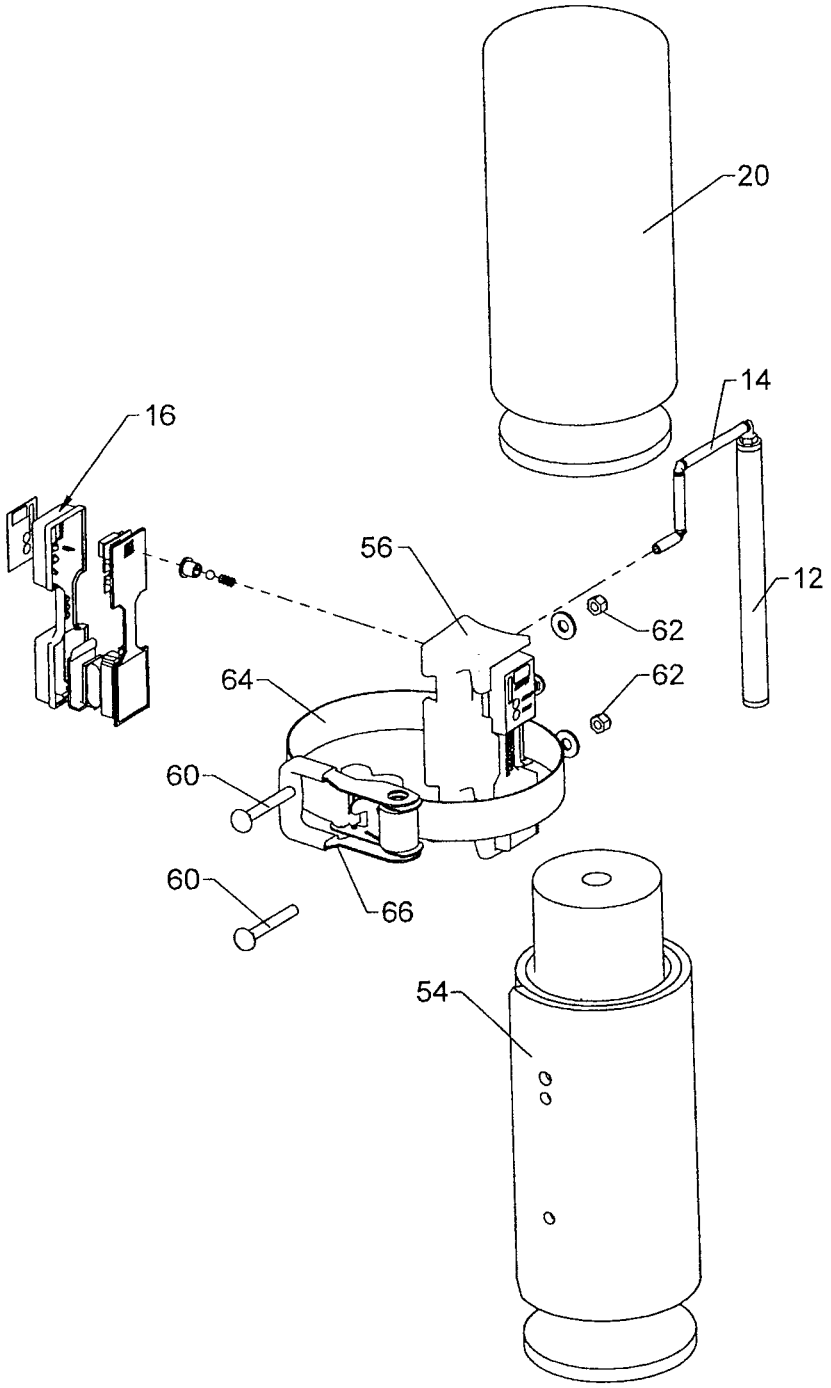
FIG. 7 is an exploded view of one embodiment of the instant invention.
Figure 8:
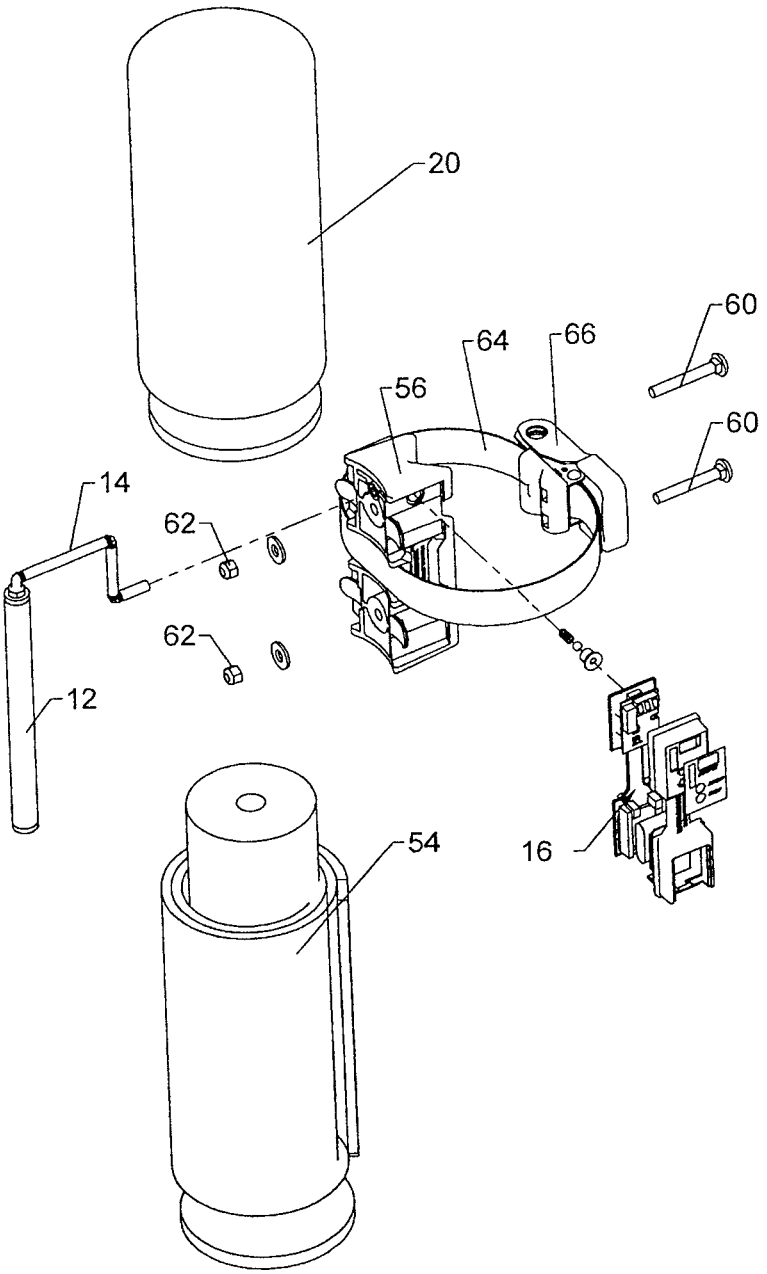
FIG. 8 is an exploded view of one embodiment of the instant invention.
Figure 9:
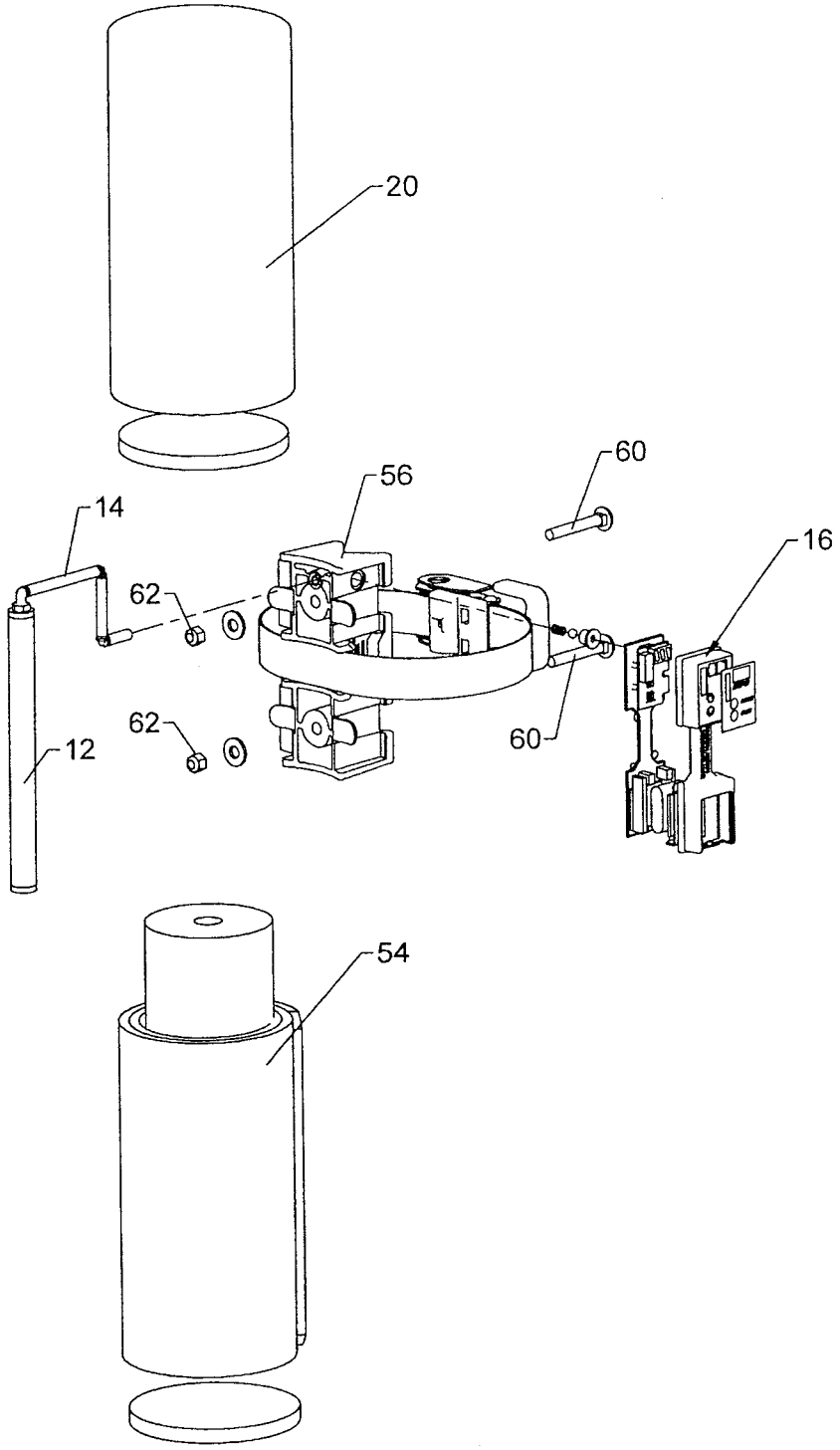
FIG. 9 is an exploded view of one embodiment of the instant invention.
Figure 10:
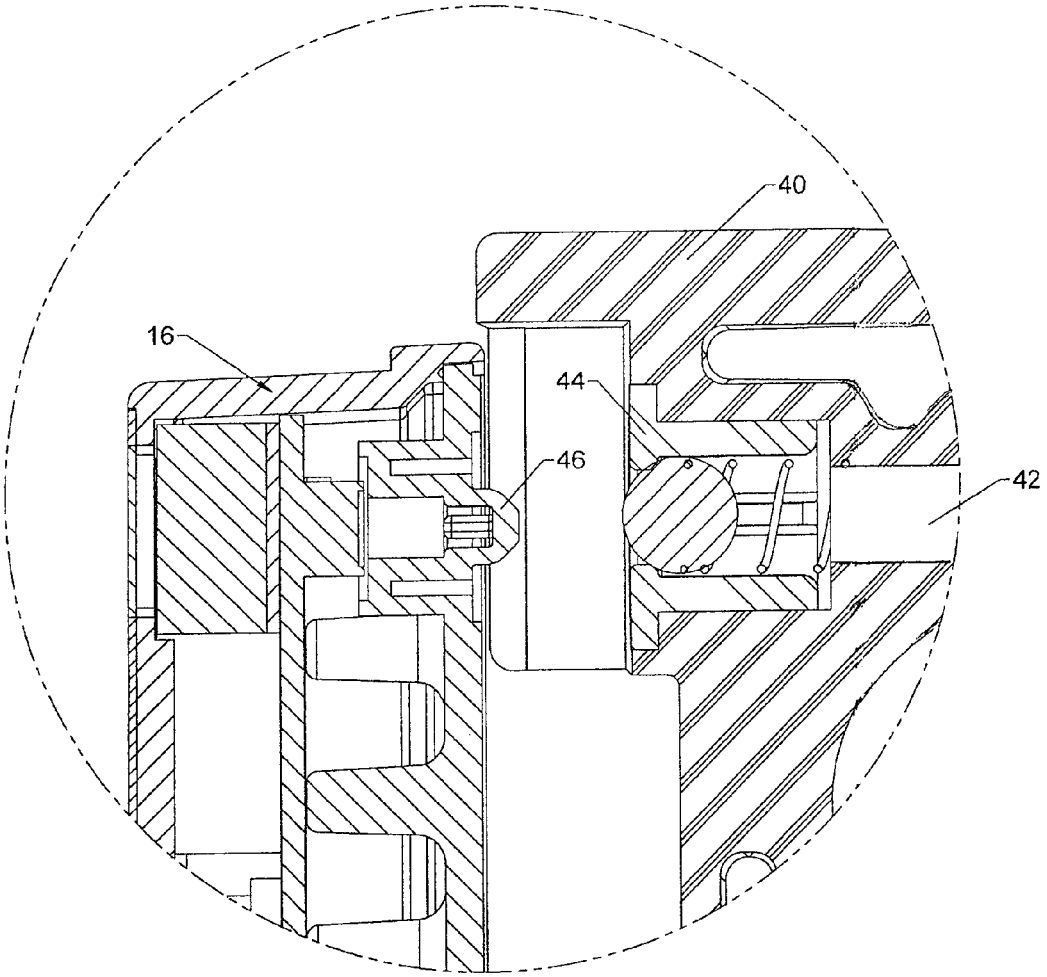
FIG. 10 is a partial section view taken along lines 10-10 of FIG. 4, illustrating assembly of the electronic module to a manifold.
Figure 11:
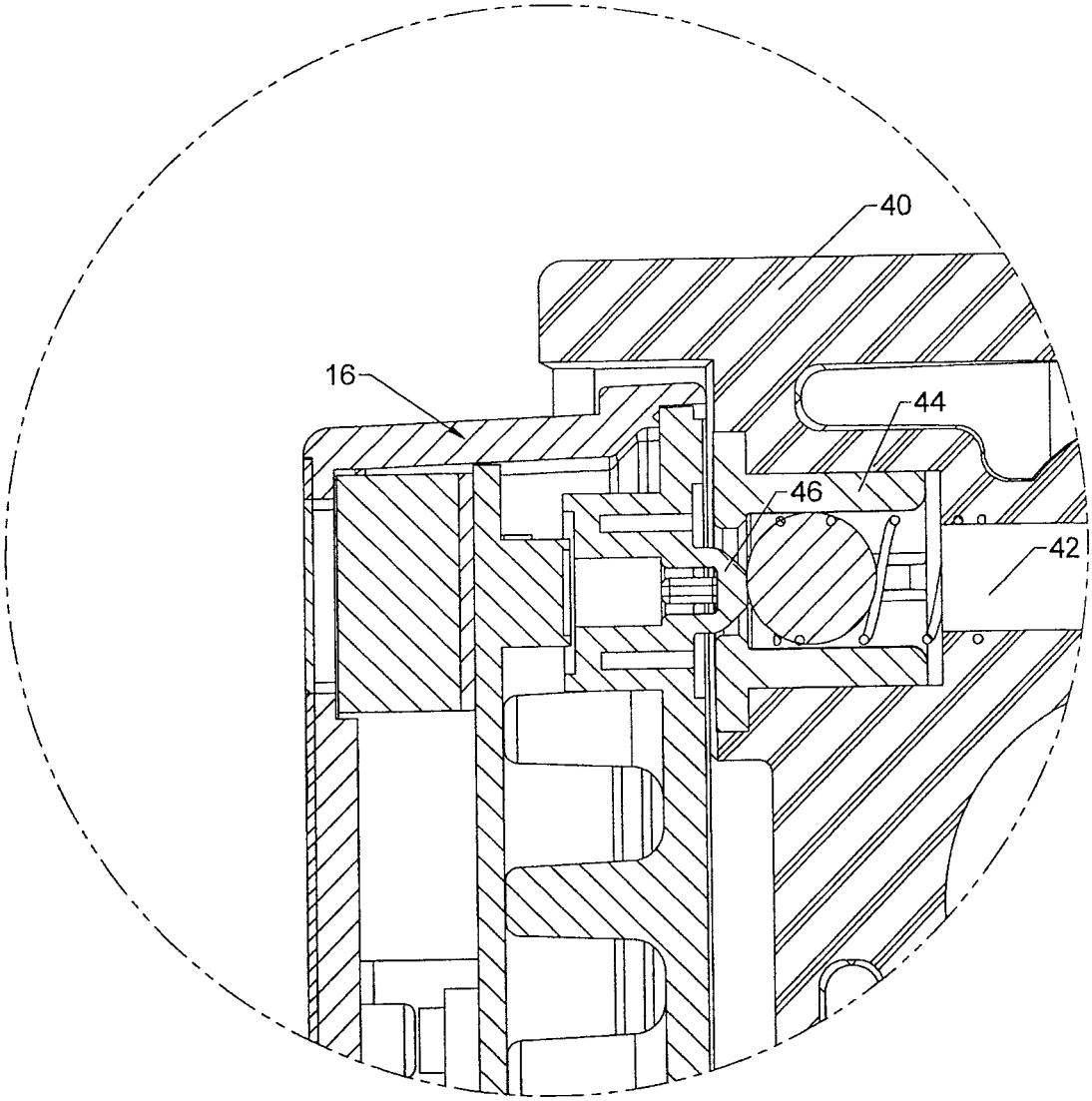
FIG. 11 is a partial section view taken along lines 10-10 of FIG. 4, illustrating the electronic module assembled to a manifold.
Figure 12:
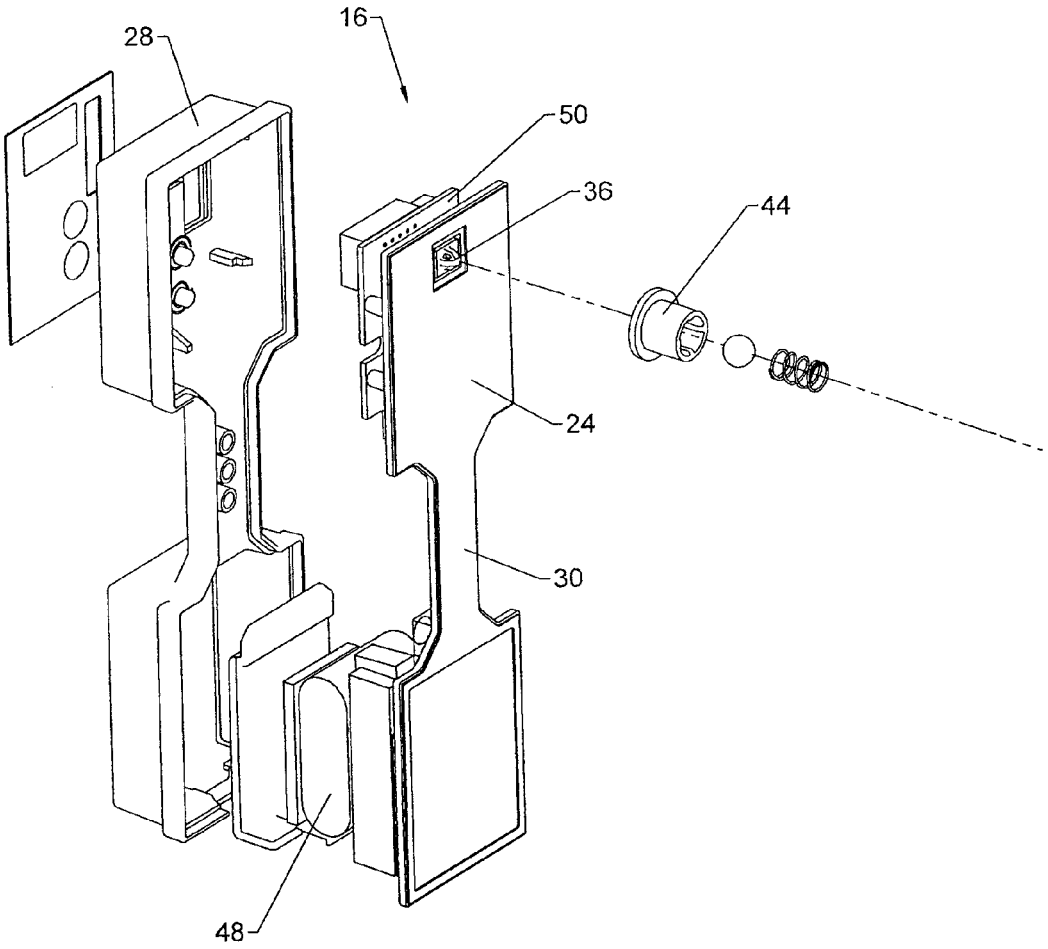
FIG. 12 is a rear perspective and partially exploded view of the electronic module.
Figure 13:
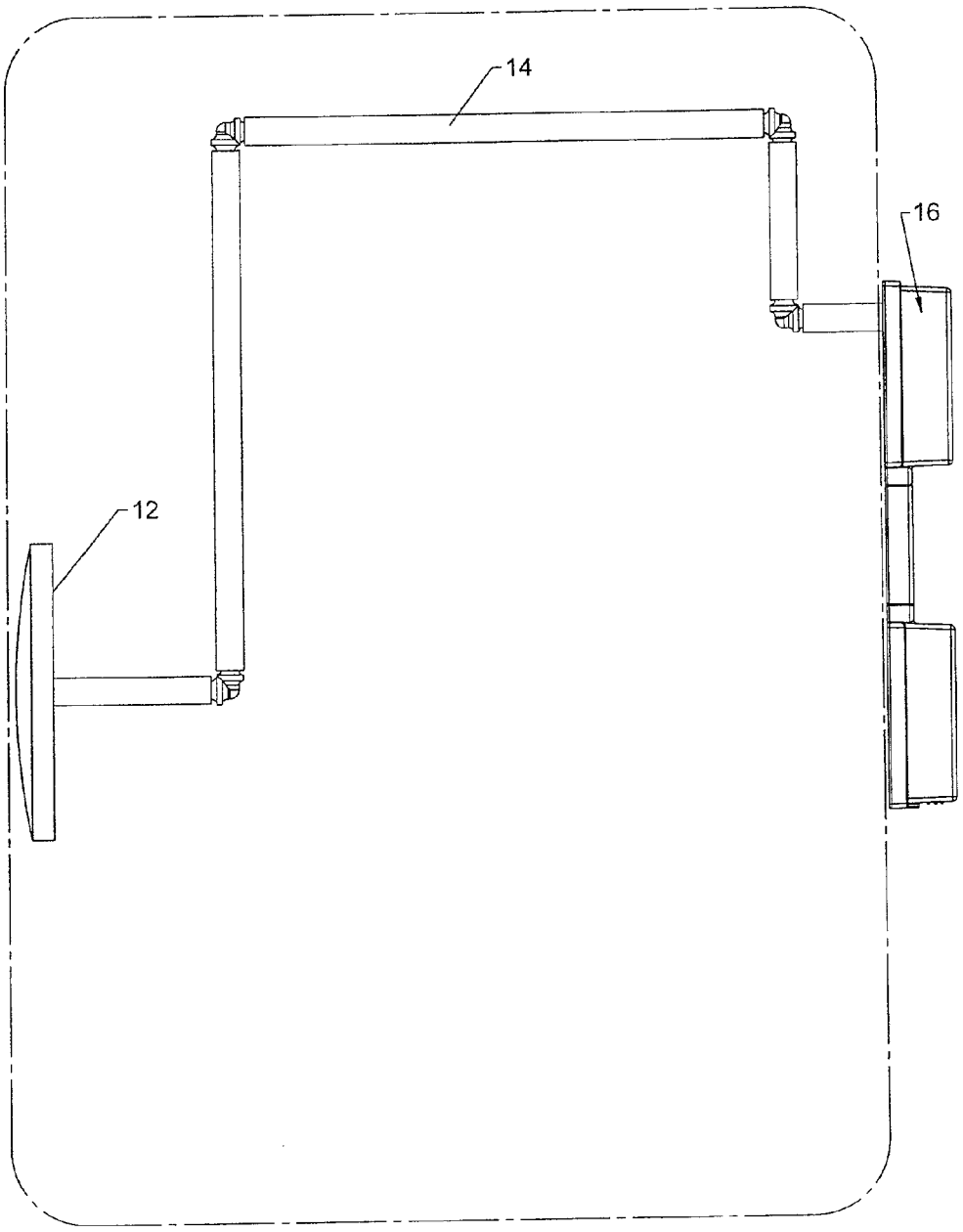
FIG. 13 is a side view illustrating one embodiment of the instant invention positioned within a heavy training bag.

Referring to FIGS. 4-9, the impact assessment device is illustrated secured to an impact training aid 52. The impact training aid 52 generally includes a vertically oriented resilient cylindrical body 54 typically fabricated from a dense foam, rubber, or the like, capable of withstanding repeated strikes from a hand, foot or sporting device such as a bat, hockey stick or the like without incurring damage or permanent deformation. A visible target may be painted or embossed on an outer skin 20 of cylindrical body 54. A mount assembly 56 is affixed to a rear portion of cylindrical body 54 at a circumferential position being about 180 degrees opposite from the target strike area. The mount assembly 56 includes mount 58, which is preferably fabricated of a molded resin and is affixed to cylindrical body 54 with bolts 60 and nuts 62. Nuts can be wing nuts to permit the easy replacement of cylindrical body 54. A strap 64 is also affixed to mount 58 and includes a buckle 66 for adjustably securing training aid 52 to an external support. Mount 58 also defines a vertically oriented elongate recess 68 for receiving a portion of an external support therein for maintaining the impact training aid in alignment with the external support. In general, the impact module 12 is placed along a front or target surface 18 of the training aid and behind an outer skin 20, see FIGS. 6 and 13. In other embodiments, which generally are subject to relatively high impact forces, the impact module may be further placed behind padding 21 or rubber like materials to distribute the force across a larger area of the impact module, see FIG. 6. FIG. 6 illustrates one embodiment of the training aid 52 wherein cylindrical body 54 is formed by rolling a flat resilient foam pad or rubber sheet into cylindrical form and then affixing mount assembly 56 and adjustable strap 64 thereto with bolts 60 and nuts 62. Alternatively, the cylindrical body 54 may take other forms and shapes as illustrated in FIGS. 18-22, and may be fabricated with alternative techniques including injection molding, rolling and the like. Some examples of impact training aids include, but should not be limited to, baseball training devices, martial arts training devices, football training devices, hockey training devices, tennis training devices, boxing training devices, soccer training devices and the like. Within each of these devices, the portable impact assessment device can be incorporated, temporarily placed and moved from training aid to training aid as desired. It should be noted that as used herein the term portable refers to an impact assessment device that is constructed and arranged to be installed and removed from various impact training aids so that at least the same electronics module can be used with numerous impact training aids. It should also be noted that the obtained data can be wirelessly transmitted to a remote receiving apparatus (not shown), such as a computer.

Referring to FIGS. 18-22, the impact assessment device 10 is illustrated in use with various impact training aids 52. In general, the impact training aid 52 is placed against a substantially vertical support such as a pole, hanging bag, a fence post, net support or the like. These figures are exemplary and those practiced in the art will understand that impact training aid 52 can also be readily attached to other supports in like manner. When utilized with a pole or the like, the pole is partially received in recess 68 of mount 58 (FIG. 6) to substantially align training aid 52 with a longitudinal axis of the support. Strap 64 and buckle 66 are adjusted to secure training aid 52 to the support such that target area is at a desired height above the ground corresponding to the user's height.

Figure 14:
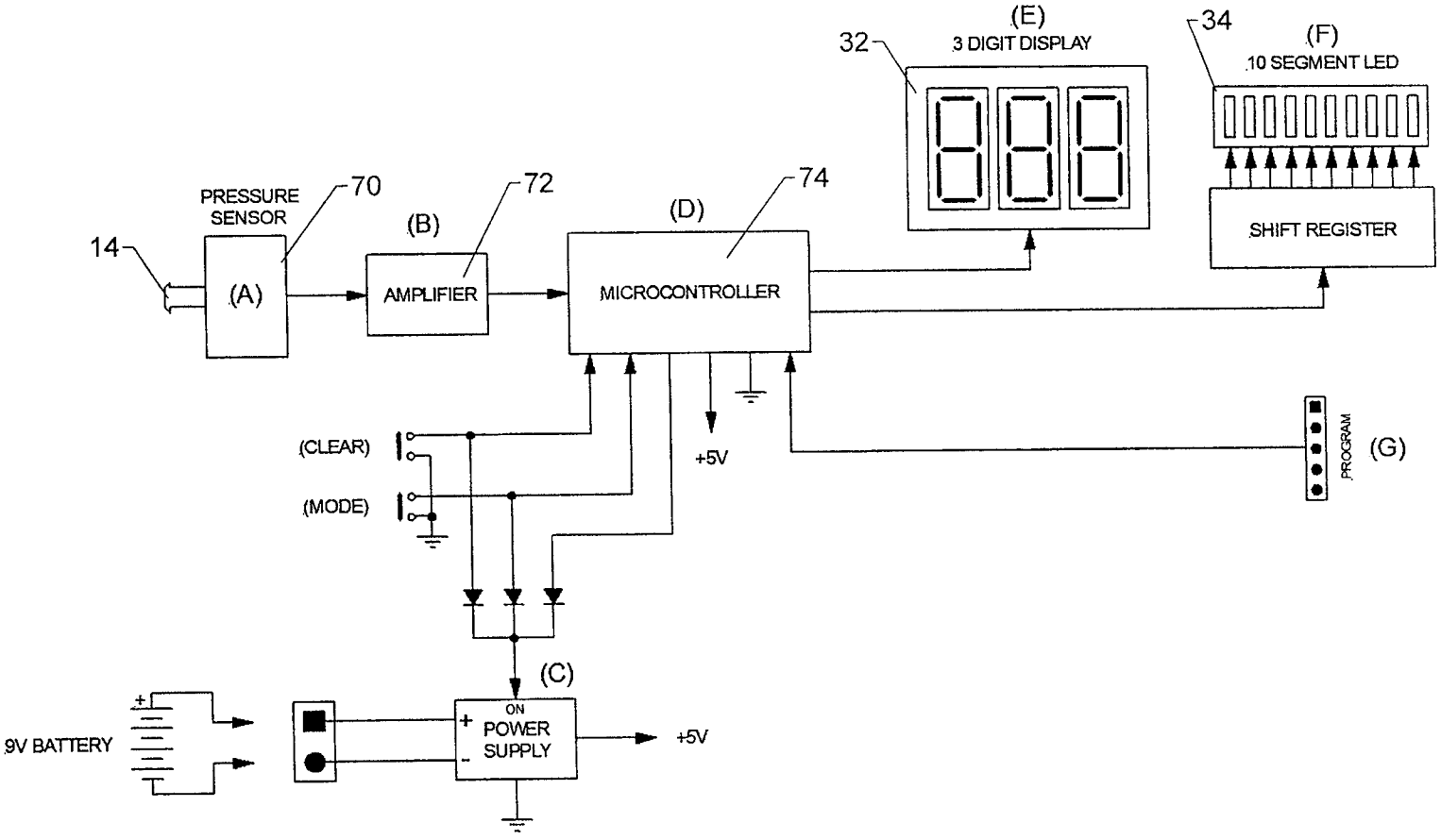
FIG. 14 is a block diagram of one embodiment of the electronic module of the instant invention.
Figure 15:
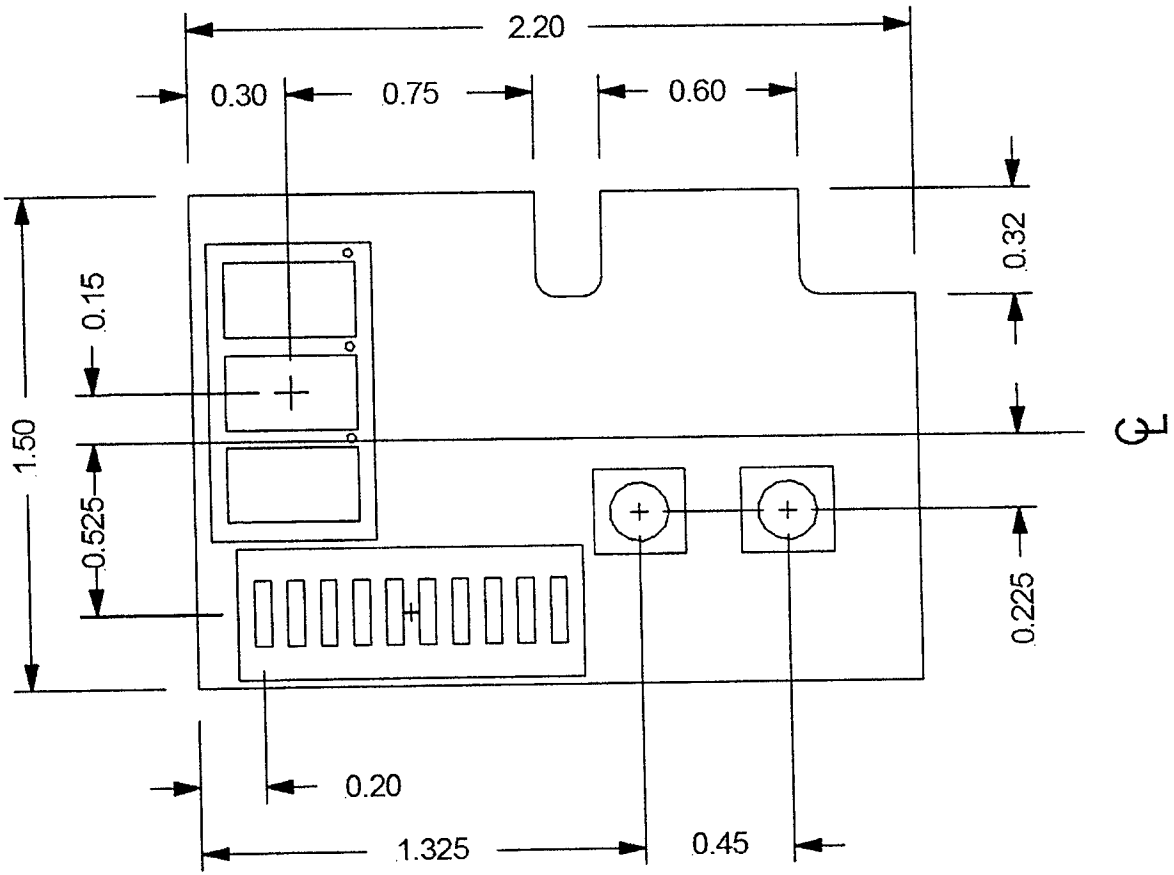
FIG. 15 is a diagram of the circuit board for the electronic module of the instant invention.
Figure 16:
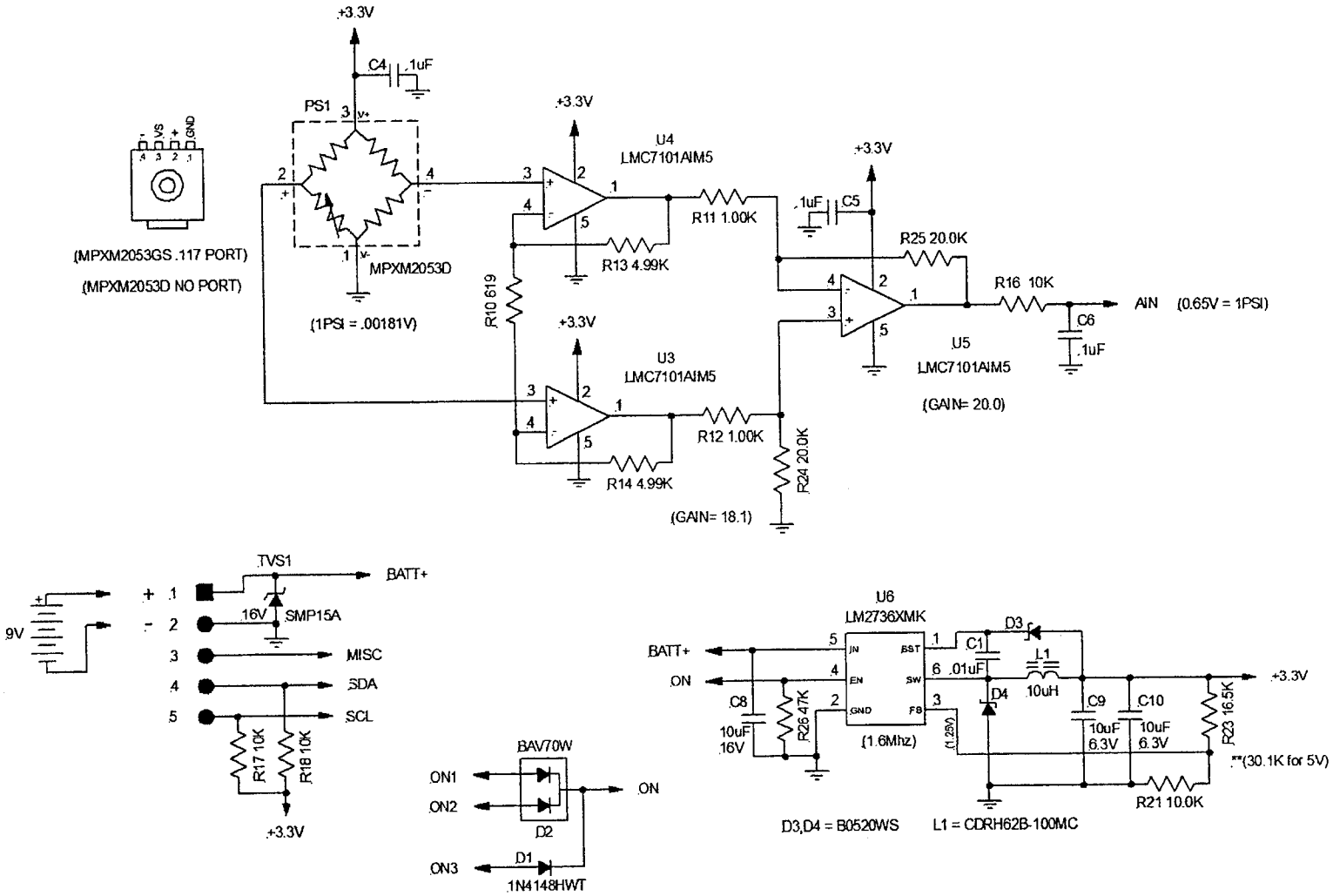
FIG. 16 is a schematic diagram of one embodiment of the electronic module.
Figure 17:
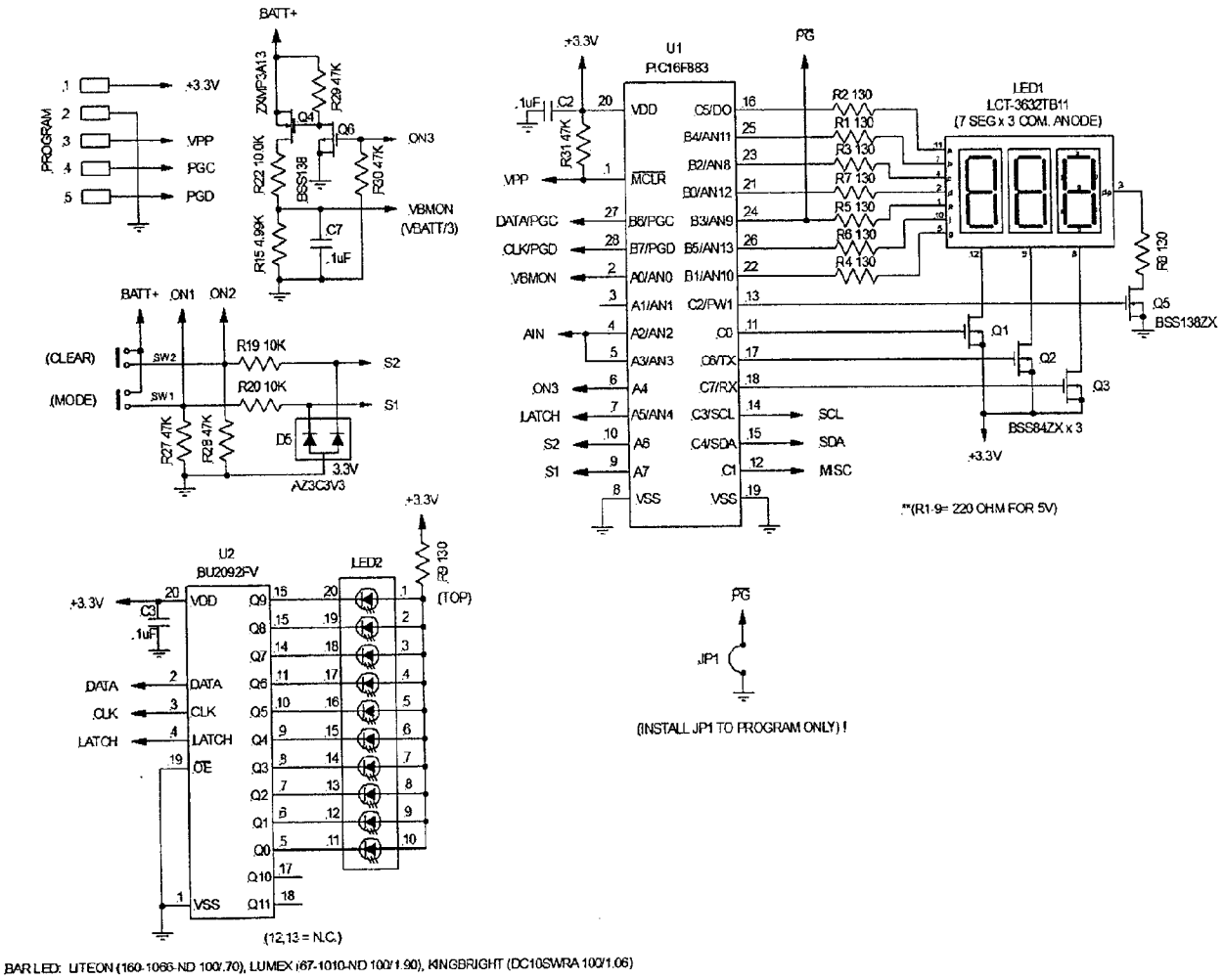
FIG. 17 is a schematic diagram illustrating various portions of the electronic module diagram of FIG. 16.
Figure 18:
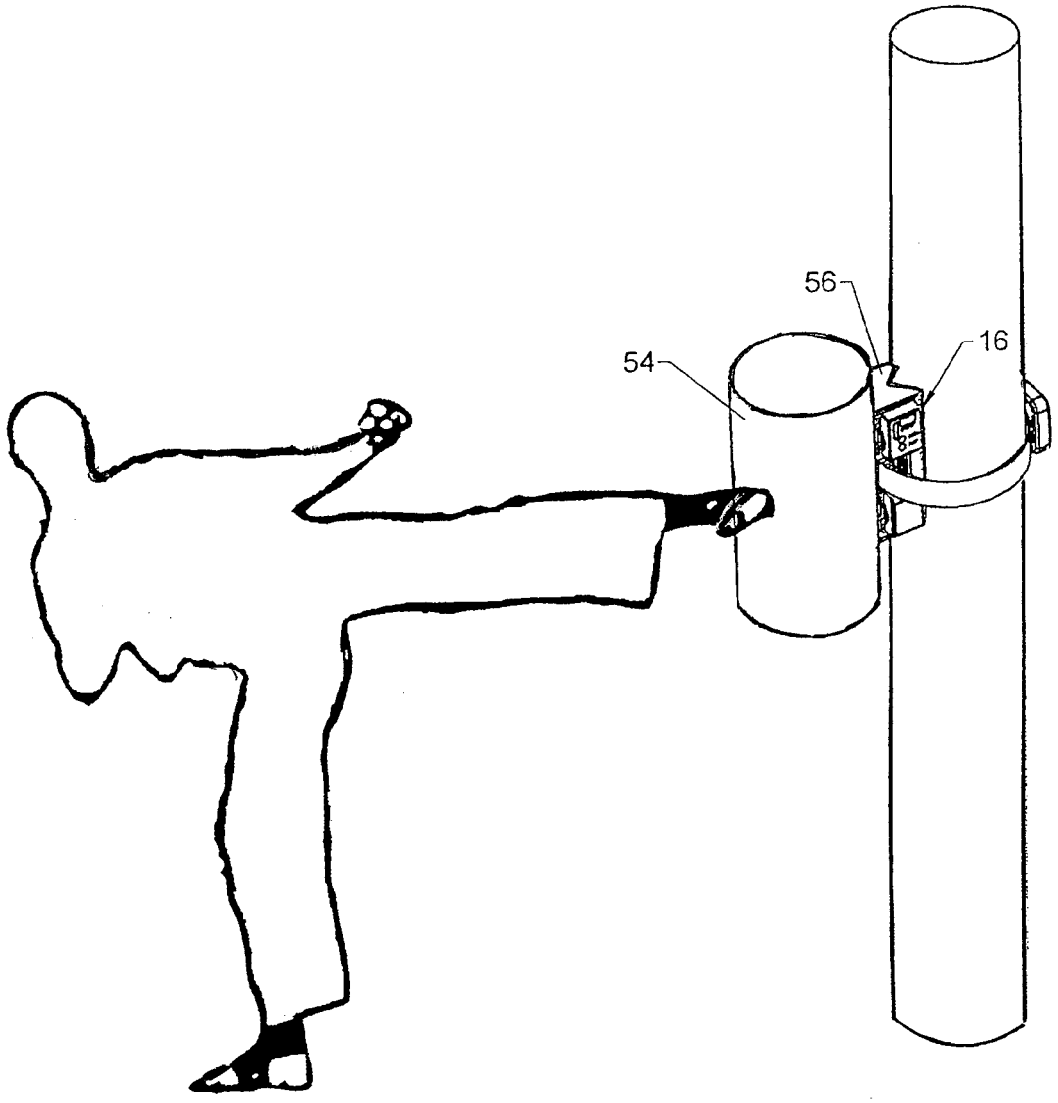
FIG. 18 is a perspective view illustrating one embodiment of the instant invention being utilized in a vertical bag for martial arts impact training.
Figure 19:
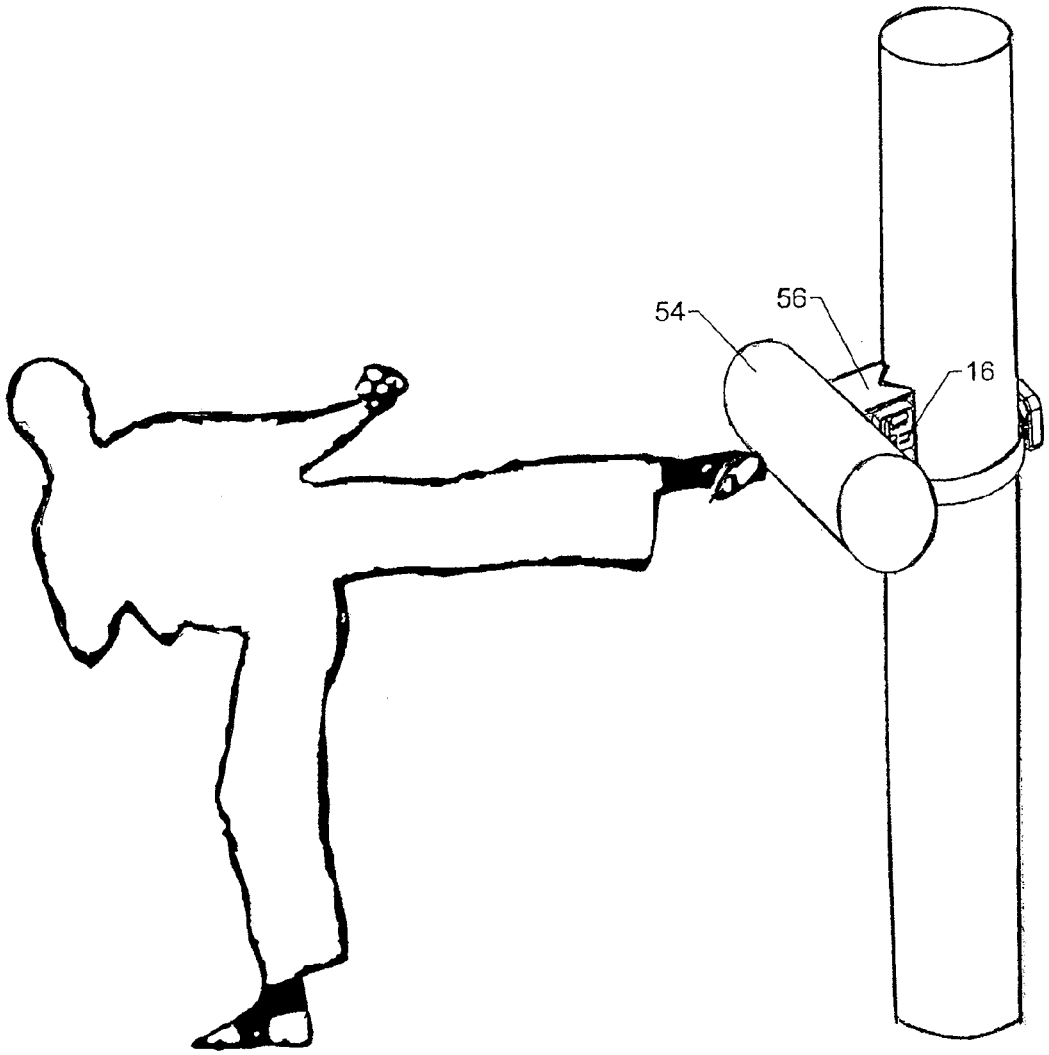
FIG. 19 is a perspective view illustrating one embodiment of the instant invention being utilized in a horizontal bag for martial arts impact training.
Figure 20:
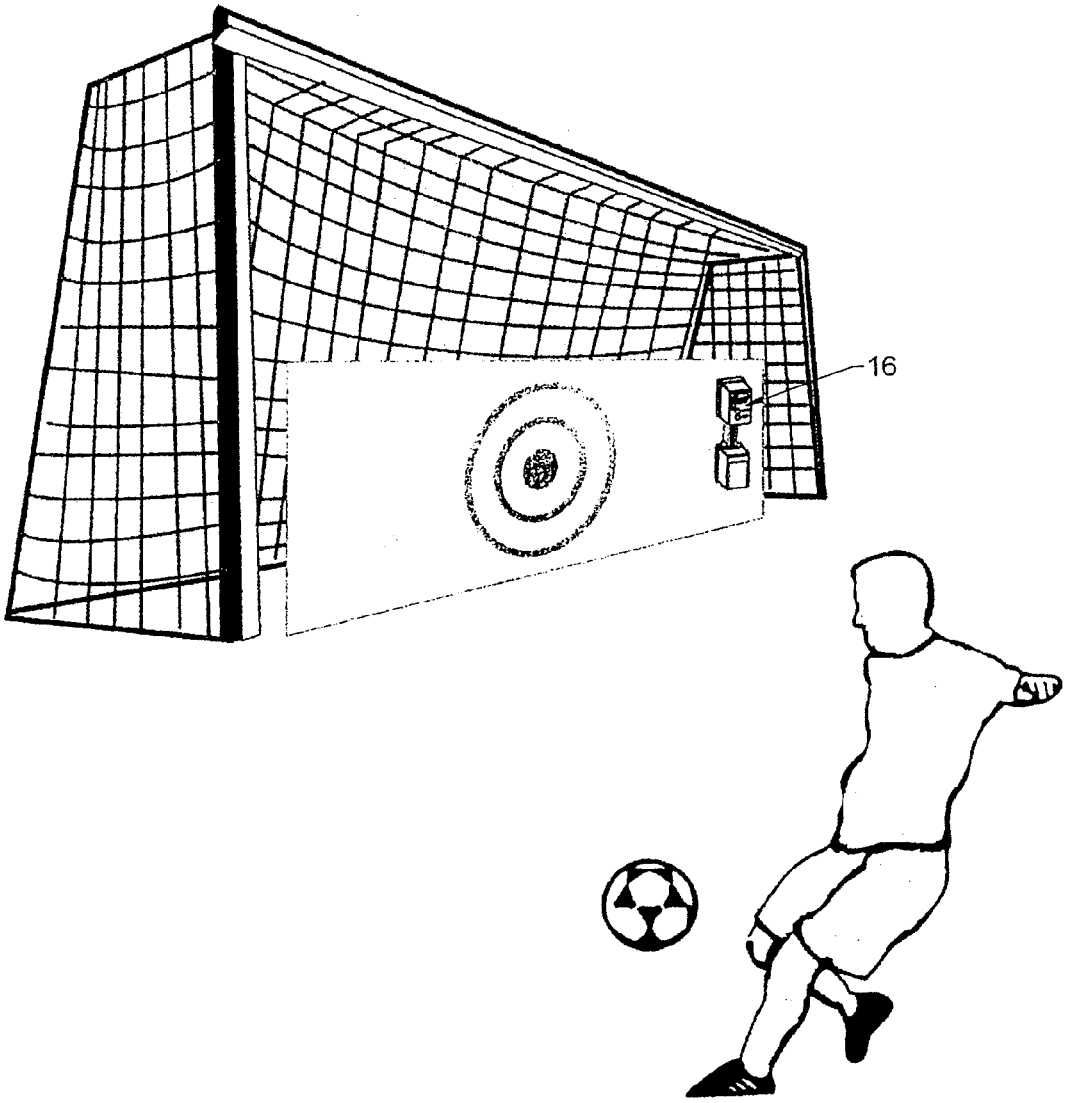
FIG. 20 is a perspective view illustrating one embodiment of the instant invention being utilized in a target for soccer training.
Figure 21:
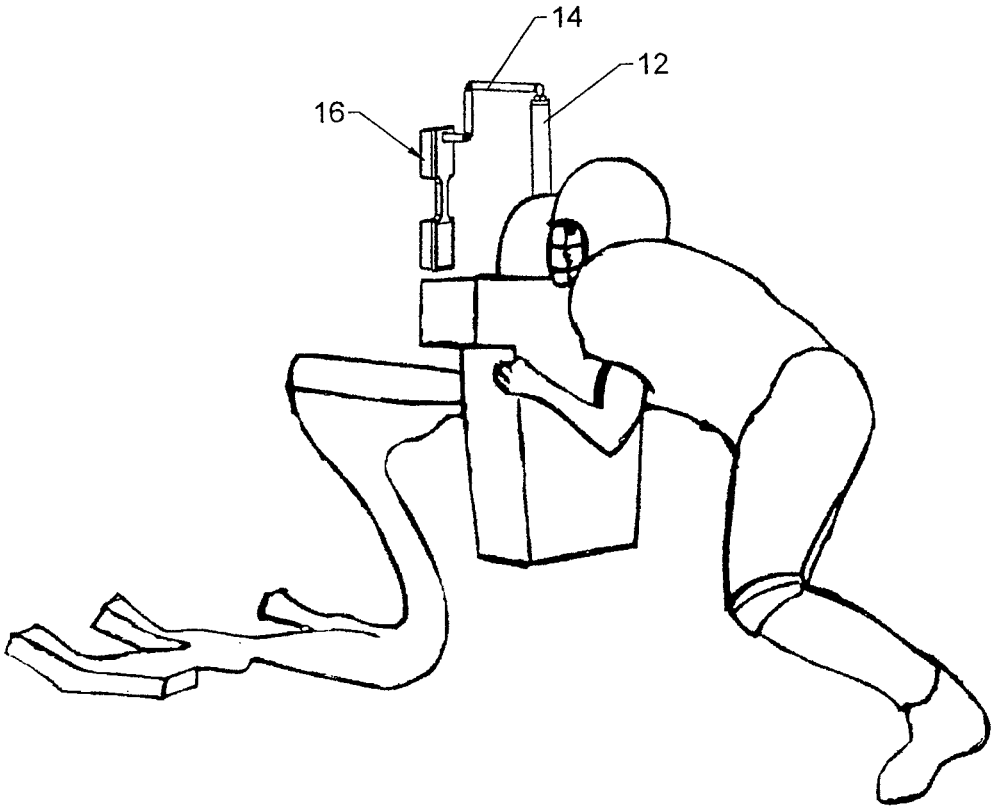
FIG. 21 is a perspective view illustrating one embodiment of the instant invention being utilized in a tackling dummy for football training.
Figure 22:
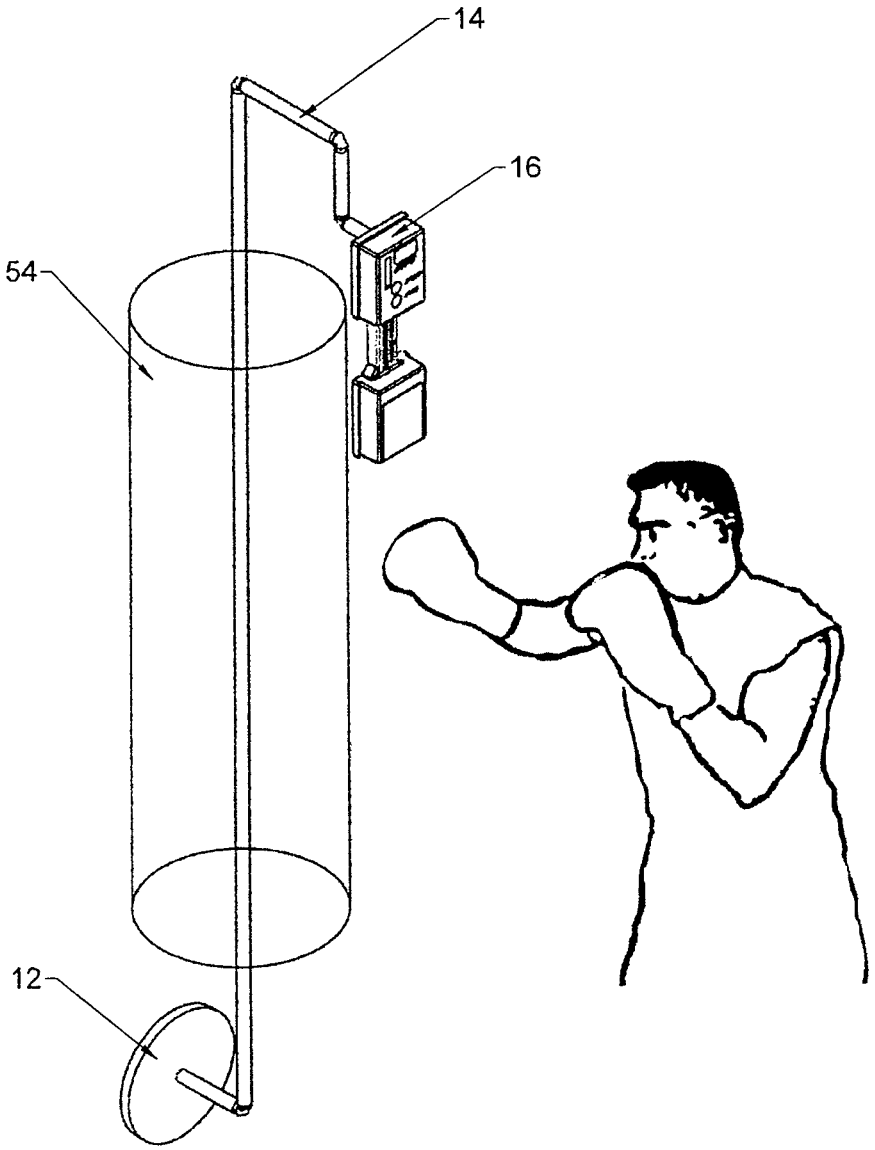
FIG. 22 is a perspective view illustrating one embodiment of the instant invention being utilized in a boxing heavy bag for boxing training.

Referring to FIGS. 14-17, various portions of the electronics schematics and circuit boards are illustrated. FIG. 14 illustrates a block diagram of the electronics circuit wherein the fluid pressure pulse is received via conduit 14 to pressure sensor 70. The output from the pressure sensor is then amplified and conditioned by amplifier 72 before being sent to microcontroller 74. The microcontroller processes the data for display on the three digit display 32 and/or the ten segment LED 34. It should be noted that the microcontroller is preferably programmed to include a sleep mode to shut the display down if no impact is received for more than one minute, and the microcontroller itself will be shut down if no impact is registered for about 30 minutes. The microcontroller also includes a low battery indication should the battery voltage fall below 8.6 volts.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The invention claimed is:

1. A portable impact assessment device for sports training devices comprising:

an impact module constructed from a resilient material of sufficient size to contain sufficient volume of a gaseous fluid, to create a pressure impulse upon receiving an impact, said impact module sized and shaped to be positioned within a sports training device that receives impact;

an electronics module having a tubular conduit for plug in fluid connection to said impact module, said electronics module including an outer case portion for protection of electrical components positioned therein, said electrical components constructed and arranged to provide a visual display representative of an impact received by said impact module, said electronics module is installed, removed and transferred from one impact training device to another so that a pressure sensor within said electronics module receives said pressure impulse, said pressure sensor generating an electrical signal based on said pressure impulse for display upon said visual display, whereby the same said electronics module can be used with numerous impact training aids.

2. The portable impact assessment device for sports training devices of claim 1 wherein said conduit assembly includes one or more fittings interposed along said conduit assembly to provide a tortuous path for transfer of said pressure impulse.

3. The portable impact assessment device for sports training devices of claim 1 wherein said tubular conduit assembly includes a check valve, said check valve constructed and arranged to allow said pressure impulse to be transferred out of said impact module only while said electronics module is plugged in thereto.

4. The portable impact assessment device for sports training devices of claim 1 wherein at least one said conduit assembly is fluidly connected to a manifold, said manifold including at least one internal passage for transfer of said pressure impulse, said manifold constructed and arranged for plug in fluid connection with at least one said electronics module.

5. The portable impact assessment device for sports training devices of claim 4 wherein said manifold also functions as a mount assembly, said mount assembly constructed and arranged to support said impact assessment device on a variety of surfaces and includes at least one internal passage for transfer of said pressure impulse.

6. The portable impact assessment device for sports training devices of claim 5 wherein each said internal passage includes a check valve, said check valve constructed and arranged to allow said pressure impulse to be transferred out of said internal passage only while an electronic module is plugged in for fluid connection thereto.

7. The portable impact assessment device for sports training devices of claim 1 wherein said electrical signal is transferred to an amplifier for amplification and conditioning of said electrical signal, said conditioned electrical signal transferred to a microcontroller, said microcontroller constructed and arranged to process said conditioned electrical signal and in response to said processing deliver electrical signals to provide said visual display representative of an impact received by said impact module.

8. The portable impact assessment device for sports training devices of claim 7 wherein said visual display is a three digit display, said three digit display constructed and arranged to display letters and numbers representative of said impact to said sports training device.

9. The portable impact assessment device for sports training devices of claim 7 wherein said three digit display is constructed and arranged to display a count of the number of hits received by said impact module.

10. The portable impact assessment device for sports training devices of claim 7 wherein said three digit display is constructed and arranged to display a direct reading of the impact force received by the device.

11. The portable impact assessment device for sports training devices of claim 7 wherein said visual display is a ten segment bar graph, said ten segment bar graph constructed and arranged to illuminate said segments representative of said impact to said sports training device.

12. The portable impact assessment device for sports training devices of claim 7 wherein said ten segment display is calibrated to display the force of each impact wherein each said segment represents a predetermined amount of force received in the impact.

13. The portable impact assessment device for sports training devices of claim 7 wherein said microcontroller includes a sleep mode for disabling said visual display if no impact is registered for a predetermined amount of time.

14. The portable impact assessment device for sports training devices of claim 7 wherein said microcontroller includes a low battery indication should voltage supplied to said microcontroller fall below a predetermined voltage.

15. The portable impact assessment device for sports training devices of claim 1 wherein said case is divided into a battery portion and a display portion, said battery portion including at least one battery, said at least one battery in electrical connection with said electrical components.

16. The portable impact assessment device for sports training devices of claim 7 wherein said microcontroller is constructed and arranged to transfer data regarding said impacts to said training device to a remote receiving apparatus.

17. The portable impact assessment device for sports training devices of claim 7 wherein said microcontroller is constructed and arranged to wirelessly transfer data regarding said impacts to said training device to a remote receiving apparatus.

18. The portable impact assessment device for sports training devices of claim 5 wherein said manifold includes a vertically oriented elongate recess for receiving a portion of an external support therein for maintaining said impact assessment device in alignment with the external support.

19. The portable impact assessment device for sports training devices of claim 18 wherein said impact assessment device includes a vertically oriented cylindrical body constructed from a resilient polymeric material capable of withstanding repeated strikes without incurring damage or permanent deformation, said impact module positioned at a predetermined position within said cylindrical body, said electronics module positioned outside of said cylindrical body.

* * * * *